US012037030B2

(12) United States Patent
Wilczek

(10) Patent No.: US 12,037,030 B2
(45) Date of Patent: Jul. 16, 2024

(54) MEASURING APPARATUS FOR MONITORING A RAILWAY TRACK INCLUDING AN OPTICAL FIBER BEING RELEASABLY CLAMPED IN RAIL FASTENING

(71) Applicant: PRODES GmbH, Vienna (AT)

(72) Inventor: Krzysztof Wilczek, Vienna (AT)

(73) Assignee: PRODES GmbH, Vienna (AT)

( * ) Notice: Subject to any disclaimer, the term of this patent is extended or adjusted under 35 U.S.C. 154(b) by 555 days.

(21) Appl. No.: 17/283,848

(22) PCT Filed: Oct. 23, 2019

(86) PCT No.: PCT/EP2019/078791
§ 371 (c)(1),
(2) Date: Apr. 8, 2021

(87) PCT Pub. No.: WO2020/108873
PCT Pub. Date: Jun. 4, 2020

(65) Prior Publication Data

US 2021/0347394 A1 Nov. 11, 2021

(30) Foreign Application Priority Data

Nov. 26, 2018 (AT) ..... A 357/2018

(51) Int. Cl.
*B61K 9/08* (2006.01)
*B61L 23/04* (2006.01)
*E01B 9/48* (2006.01)

(52) U.S. Cl.
CPC ..... *B61K 9/08* (2013.01); *B61L 23/047* (2013.01); *E01B 9/483* (2013.01); *B61L 23/044* (2013.01)

(58) Field of Classification Search
None
See application file for complete search history.

(56) References Cited

U.S. PATENT DOCUMENTS 5,330,136 A 7/1994 Colbaugh
5,462,244 A 10/1995 Van Der Hoek et al.
(Continued)

FOREIGN PATENT DOCUMENTS

DE 4432329 A1 3/1996
EP 0 592 031 A1 4/1994
(Continued)

OTHER PUBLICATIONS

International Search Report of PCT/EP2019/078791, mailed Feb. 7, 2020.
(Continued)

*Primary Examiner* — Peter J Macchiarolo
*Assistant Examiner* — Jermaine L Jenkins
(74) *Attorney, Agent, or Firm* — Collard & Roe, P.C.; William Collard

(57) ABSTRACT

The invention relates to a measuring arrangement for monitoring a railway track having rails fastened to sleepers, wherein a fibre optic cable is connected to a measuring device in order to detect a strain acting on a rail. In this, the fibre optic cable is clamped in a detachable manner into at least one rail fastening. In this way, a strain transmitted from the rail via the rail fastening to the sleeper acts directly on the fibre optic cable.

12 Claims, 2 Drawing Sheets

(56) References Cited

U.S. PATENT DOCUMENTS

| | | | | |
|---|---|---|---|---|
| 5,529,267 | A | 6/1996 | Giras et al. | |
| 9,751,541 | B2 * | 9/2017 | Betancur Giraldo | G01M 17/10 |
| 10,907,958 | B2 * | 2/2021 | Smith | B61L 25/021 |
| 2016/0356661 | A1 | 12/2016 | Glueck et al. | |
| 2018/0222498 | A1 | 8/2018 | Kelley | |

FOREIGN PATENT DOCUMENTS

| | | | | |
|---|---|---|---|---|
| EP | 1 000 833 | A1 | 5/2000 | |
| EP | 1128171 | A1 * | 8/2001 | B61L 1/166 |
| EP | 1 207 091 | A1 | 3/2002 | |
| RU | 2674547 | C1 * | 12/2018 | |
| WO | 2014/019890 | A2 | 2/2014 | |
| WO | 2015/014264 | A1 | 2/2015 | |
| WO | 2015/0110361 | A2 | 7/2015 | |
| WO | 2016/027072 | A1 | 2/2016 | |

OTHER PUBLICATIONS

Austrian Search Report in Austrian Application No. A357/2018, mailed Oct. 17, 2019.

* cited by examiner

MEASURING APPARATUS FOR MONITORING A RAILWAY TRACK INCLUDING AN OPTICAL FIBER BEING RELEASABLY CLAMPED IN RAIL FASTENING

CROSS REFERENCE TO RELATED APPLICATIONS

This application is the National Stage of PCT/EP2019/078791 filed on Oct. 23, 2019, which claims priority under 35 U.S.C. § 119 of Austrian Application No. A 357/2018 filed on Nov. 26, 2018, the disclosure of which is incorporated by reference. The international application under PCT article 21(2) was not published in English.

FIELD OF TECHNOLOGY

The invention relates to a measuring arrangement for monitoring a railway track having rails fastened to sleepers, wherein a fibre optic cable is connected to a measuring device in order to detect a strain acting on a rail. In addition, the invention relates to a method for creating a corresponding measuring arrangement.

PRIOR ART

Various measuring systems are used on railway tracks to monitor the railway infrastructure, the railroad traffic and other activities on the track. In corresponding measuring arrangements, fibre optic cables are increasingly gaining in importance. These are used, on the one hand, for signal transmission and, on the other hand, as elements of a sensor.

According to WO 2016/027072 A1, for example, a measuring system and a corresponding measuring method with a fibre optic cable laid adjacent to the track are known. Connected to the fibre optic cable is a measuring device by means of which so-called distributed acoustic sensing (Distributed Acoustic Sensing, DAS) takes place. In this, at least one fibre of the fibre optic cable is used to detect reflections of laser impulses. The registered light signals allow conclusions as to vibrations along the railway track. Specifically, wheels of trains are monitored by this in order to recognize damages early on. The solution is aimed at utilizing as a sensor element a fibre optic cable which is already installed for other purposes.

WO 2015/110361 A2 discloses a measuring device having a fibre-optic sensor unit for measuring a mechanical factor acting on a rail. In this, the fibre-optic sensor unit is arranged obliquely on a rail web and is illuminated by a primary light for generating a signal light in reflection or transmission. The signal light is analyzed in order to draw conclusions as to load fluctuations in the rail.

SUMMARY OF THE INVENTION

It is the object of the invention to improve a measuring arrangement of the type mentioned at the beginning so that it can be produced and maintained in a simple manner, and so that precise measuring results can be achieved with high replicability. It is a further object of the invention to indicate a method for creating the corresponding measuring arrangement.

According to the invention, these objects are achieved by way of the features of claims 1 and 10. Advantageous further developments of the invention become apparent from the dependent claims.

In this, it is provided that the fibre optic cable is clamped in a detachable manner into at least one rail fastening. In this way, a strain transmitted from the rail via the rail fastening to the sleeper acts directly on the fibre optic cable. Also vibrations from sources in the track vicinity act via the sleeper and the rail fastening on the fibre optic cable and can thus be detected. The resulting slight deformations of the fibre optic cable can be evaluated with known methods. In this, the measuring device connected to the fibre optic cable sends light signals into the fibre optic cable, wherein reflections of these light signals correlate to the deformations of the fibre optic cable. The precise localization of a deformation is possible with this also. Thus, vibrations or wheel loads are detected in an immediate manner since the fibre optic cable is arranged in the force path between rail and sleeper. By installing the fibre optic cable in a load-dissipating component of the rail fastening, a great signal headway (measuring signal to noise) between a loaded and an unloaded state is generated during detection. Thus, the utilization, according to the invention, of the fibre optic cable as a detector element is subject to significantly fewer interfering influences than are known solutions. In addition, the measuring arrangement enables a status analysis of the rail fastening under load.

In an advantageous further development of the arrangement, the fibre optic cable is clamped into the rail fastenings of the same rail at, at least, two successive sleepers. Favourably, the fibre optic cable extends over a wide area of the railway track to be monitored and, in the process, is clamped into all rail fastenings of the same rail. In this way, the fibre optic cable serves as sensor element with a longitudinal extension across a multitude of sleepers. Contrary to a fibre optic cable guided next to the track in a cable trough, the fibre optic cable arranged according to the invention is excited in discrete sections (respective point of contact with a sleeper). As a result, a separate virtual sensor can be associated with each sleeper. With a local allocation of the measuring results, each individual sleeper is monitored. For example, cavities or rail fastenings becoming loose can be recognized immediately. Axle counters can also be realized in this manner, wherein there is an interoperability with existing systems. In addition, the calibration of the measuring arrangement by the discrete excitation of the fibre optic cable is simpler than with known systems.

A further improvement provides that the fibre optic cable has a loop for length compensation between two clamping points. With this, changes can be made in the measuring arrangement, if required. In addition, there is the possibility to detach the fibre optic cable from the clamping points at a construction site and deposit it next to the track. For example, prior to welding the rail, the fibre optic cable is deposited at a sufficient distance from the welding site with utilization of the length compensation.

In the mounted state of the measuring arrangement, it is advantageous if the fibre optic cable is fastened to the rail between two successive sleepers in a detachable manner by means of a fastening means. For example, a clamp clipped to the rail base prevents the fibre optic cable from sagging between the sleepers. This additional protective measure is useful in particular for problem-free execution of maintenance procedures such as rail grinding, track tamping or track stabilizing.

An advantageous further development of the measuring arrangement provides that the at least one rail fastening includes an intermediate layer as support of the rail base, and that the clamped fibre optic cable rests against the intermediate layer. In this, vertical loads on the rail are transmitted immediately to the fibre optic cable. Additionally with this arrangement, the fibre optic cable is protected by the rail from exterior influences.

Another further development provides that the at least one rail fastening includes a tension clamp, and that the clamped fibre optic cable rests against the tension clamp. Particularly vibrational stresses of the rail are dissipated via the elastic tension clamps. Such stresses can be detected particularly well by the closely fitting fibre optic cable. Also advantageous here is the simple possibility to detach the clamping of the fibre optic cable by relaxing the tension clamp.

A further advantageous variant enables a very precise recording of horizontal transverse stresses. In this, the at least one rail fastening includes a lateral guide for lateral support of the rail base, wherein the clamped fibre optic cable rests against the lateral guide.

In a favourable embodiment of this variant, the lateral guide is an angle guide plate. In a corresponding rail fastening, an angle guide plate is arranged at each side of the rail base in order to fixate the lateral position of the rail. In this, the respective angle guide plate serves, as a rule, also as support for a tension clamp.

Alternatively, the at least one rail fastening may include a ribbed base plate, wherein ribs extending parallel to the rail are arranged as lateral guides. Such a ribbed base plate is normally used in connection with a wooden sleeper in order to also ensure a prescribed inclination of the rail towards the track center. Here, screws are mostly used as fastening elements.

The method according to the invention for creating one of the described measuring arrangements provides that, during new track construction or track renewal, a rail is laid on sleepers by means of a track maintenance machine, that—before, after or during this—the fibre optic cable is reeled off a spool arranged on the track maintenance machine and is positioned at respective clamping points, and that the rail is fastened to the sleepers by means of the rail fastenings with simultaneous clamping of the fibre optic cable. In this manner, the measuring arrangement is built up in the course of track construction operations, with negligible expense being necessary for this. In particular, common track maintenance machines designed for laying or exchanging sleepers can be equipped in a simple manner with a spool for reeling off the fibre optic cable.

BRIEF DESCRIPTION OF THE DRAWINGS

The invention will be described below by way of example with reference to the accompanying drawings. There is shown in a schematic manner in.

DESCRIPTION OF THE EMBODIMENTS

Figure 1:
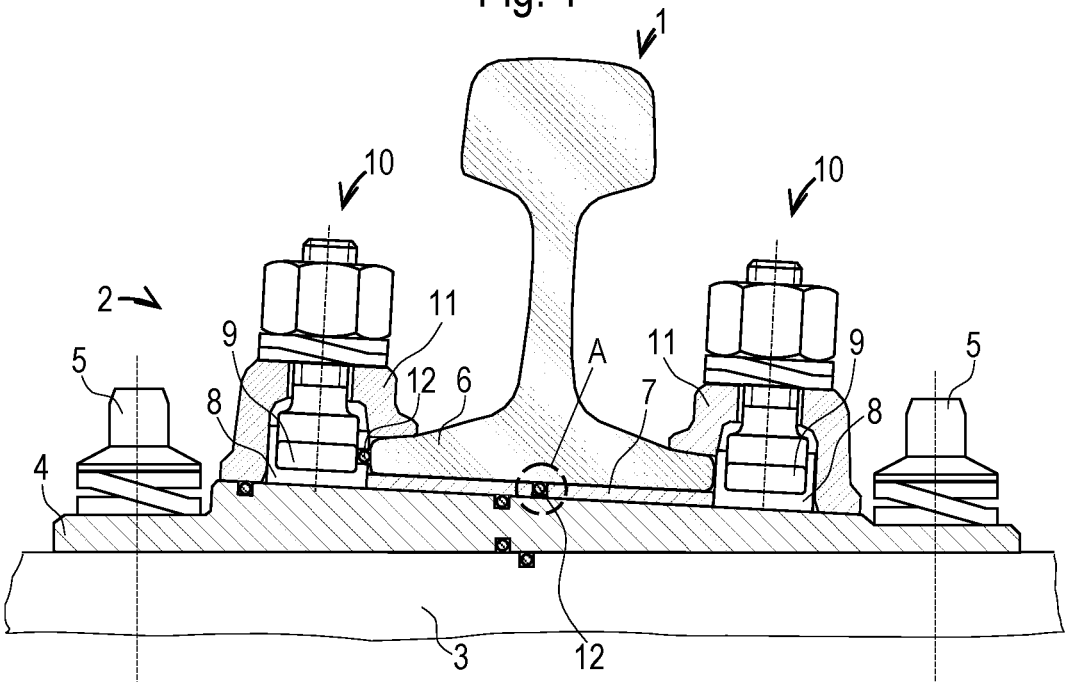
FIG. 1 a cross-section of a rail and a rail fastening with a ribbed base plate FIG. 2 detail A of FIG. 1 with fibre optic cable in detached state FIG. 3 detail A of FIG. 1 with fibre optic cable in clamped state FIG. 4 a cross-section of a rail and a rail fastening with angle guide plates FIG. 5 a top view of a rail and two sleepers

A rail 1 shown in FIG. 1 is fastened in a slightly tilted way to a sleeper 3 by means of a rail fastening 2. For pre-setting an exact angle of inclination, the rail fastening 2 includes a ribbed base plate 4 which is screwed fast to the sleeper 3 by means of screws 5. An intermediate layer 7, commonly made of plastic, is arranged between the rail base 6 and the ribbed base plate 4. For lateral support, the ribbed base plate 4 has ribs 8 extending at either side of the rail 1 in the longitudinal direction of the rail. These ribs 8 have recesses, opening towards the bottom, which serve as counter-support for hook bolts 9 of screwed connections 10. By means of these screwed connections 10, a tension clamp 11 is pressed at each side of the rail 1 to the rail base 6 from above. Such an arrangement is common when using wooden sleepers.

According to the invention, at least one fibre optic cable 12 is arranged which is clamped in a detachable manner into the rail fastening 2. In this, the mechanical characteristics of the fibre optic cable 12 and the rail fastening 2 are matched to one another. For example, the fibre optic cable 12 has a coating of abrasion-resistant plastic or composite material. Thus, premature mechanical wear of the fibre optic cable 12 is avoided. Optionally, the fibre optic cable 12 is also exchanged in the course of a rail exchange, wherein the additional expense thus occurring is negligible.

In FIG. 1, several useful positions of the fibre optic cable 12 are indicated. For example, a longitudinal groove 13 for receiving the fibre optic cable 12 is provided in the intermediate layer 7. Alternatively, or additionally, the ribbed base plate 4 has a corresponding longitudinal groove 13. The longitudinal groove 13 may also be provided in the sleeper 3, so that a customary rail fastening 2 can be used without further adaptation. The same goes for a longitudinal groove 13 at the underside of the rail base 6.

Figure 2:
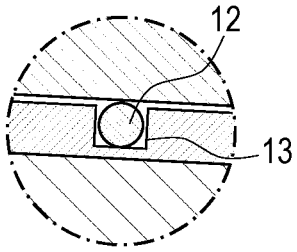
Figure 3:
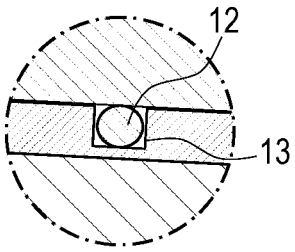

As visible in FIGS. 2 and 3, the longitudinal groove 13 in each case has a depth which is less than the diameter of the fibre optic cable 12 in the detached state. In the clamped state, the fibre optic cable 12 is pressed against surfaces of the rail fastening 2 and, optionally, of the rail 1 or the sleeper 3. As a result, loads and vibrations acting on the rail 1 or the sleeper 3 are transmitted directly to the fibre optic cable 12.

For precisely registering forces and vibrations in a horizontal direction transversely to the rails, the fibre optic cable 12 is arranged in a longitudinal groove 13 of a rib 8. In the mounted state, the fibre optic cable 12 is here clamped between the rib 8 and a lateral web of the rail base 6. In an advantageous further development, this fibre optic cable 12 is combined with a fibre optic cable 12 under the rail base 6. In this manner, a separate registration and evaluation of the horizontal and the vertical forces and vibrations is possible.

Figure 4:
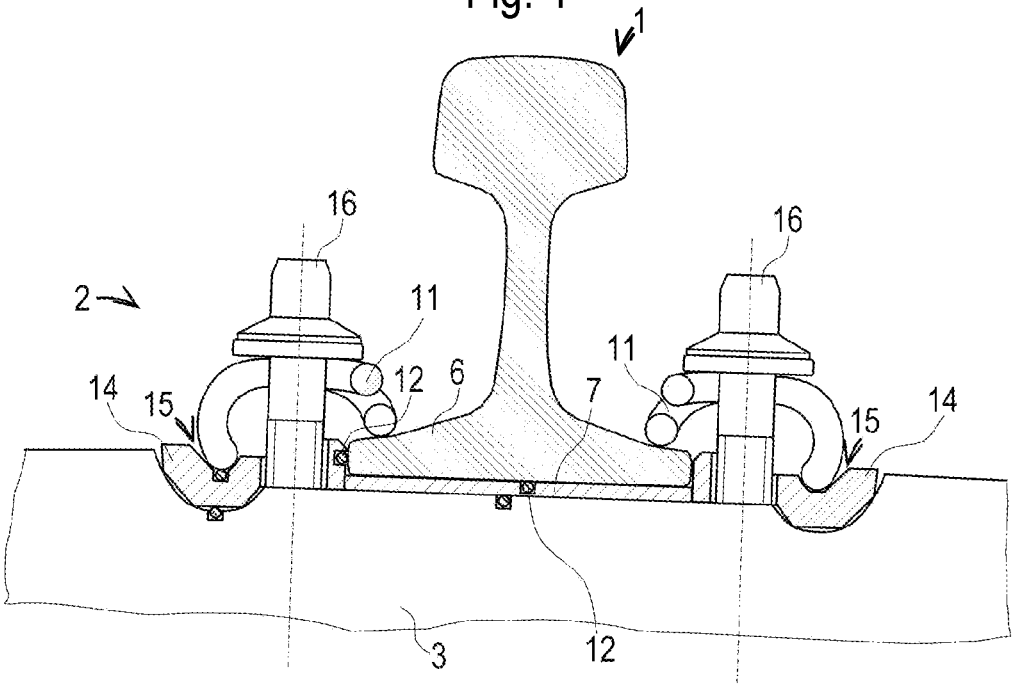

In FIG. 4, an alternative rail fastening 2 is shown which is normally used with concrete sleepers. In this, the sleeper 3 has relief-like recesses on the upper side for receiving the rail fastening 2. Specifically, an intermediate layer 7 and two angle guide plates 14 of the rail fastening 2 are arranged in these recesses. Here, the intermediate plate 7 forms a damping element between the rail base 6 and the sleeper 3. The angle guide plates 14 serve as lateral guides which fixate the rail base 7 in the horizontal direction transversely to the rail. Additionally, each angle guide plate 14 has a groove 15 in which a tension clamp 11, made of bent round material, is snapped into place. The respective tension clamp 11 is tensioned by means of a rail fastening screw 16, wherein the ends of the tension clamp 11 are pressed against the rail base 6 from above.

Here also, several useful positions of the fibre optic cable 12 are shown. For example, a longitudinal groove 13 is provided in the intermediate layer 7 or in the sleeper 3 underneath the intermediate layer 7. Also advantageous is the arrangement of the fibre optic cable 12 underneath the respective angle guide plate 14 or underneath the respective tension clamp 11. Forces and vibrations in a horizontal direction transversely to the rail are favourably detected with a fibre optic cable 12 between the angle guide plate 14 and the associated lateral web of the rail base 6. To that end, the corresponding angle guide plate 14 has a lateral longitudinal groove 13. In this variant also, the arrangement of several fibre optic cables 12 may be useful.

Figure 5:
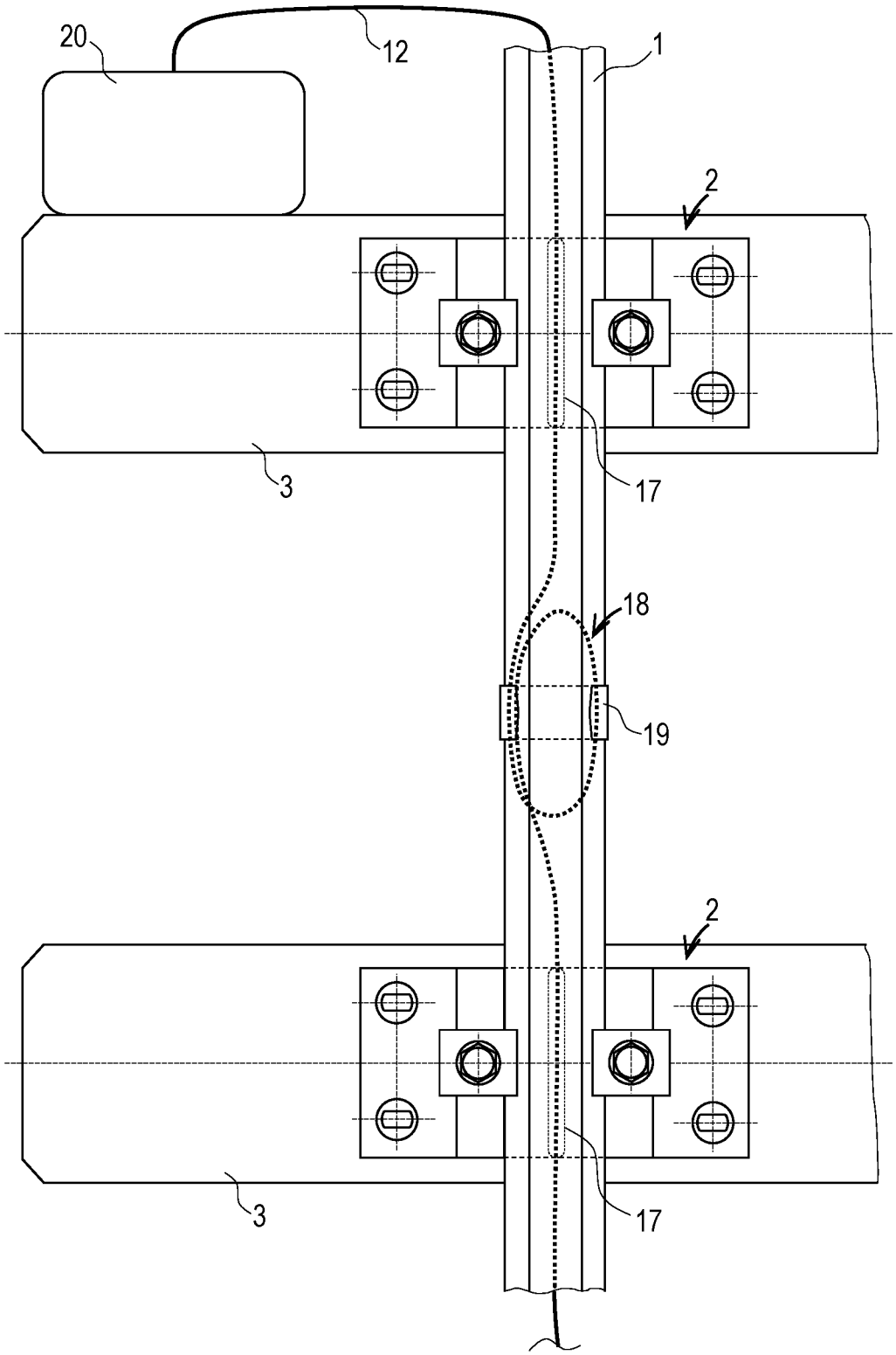

In the top view in FIG. 5, two rail fastenings 2 with a respective ribbed base plate 4 are shown by example. The fibre optic cable 12 is clamped in the respective rail fastening 2 underneath the rail 1. For example, the respective ribbed base plate 4 has a corresponding longitudinal groove 13. In the case of strains, the fibre optic cable 12 is discretely excited at these clamping points 17, so that corresponding discrete measuring results are available in the case of a measuring operation.

Between the sleepers, the fibre optic cable 12 is arranged in a loop 18. This loop 18 serves as length compensation if the fibre optic cable 12 has to be repaired or positioned in another way. In order to utilize the length compensation of several loops 18, the rail fastenings 2 lying there between are loosened, so that the fibre optic cable 12 can glide through the rail fastenings 2. For example, in the case of welding work on the rail 1, the fibre optic cable 12 is placed at a sufficient distance to the welding location by using the length compensation.

Favourably provided in the respective sleeper crib between two sleepers 3 is a fastening means 19 by means of which the fibre optic cable 12 is detachably fastened to the rail 1. In the simplest case, this is a clip which is clasped to the rail base 6 and keeps the fibre optic cable 12 in position. In this manner, the fibre optic cable 12 is sufficiently protected in the case of maintenance operations like rail grinding or track tamping. Such fastening means 19 can also be used to omit the detector function of the fibre optic cable 12 in complicated track installations. For example, in the region of a switch, the fibre optic cable 12 is clipped only to a rail 1 without any clamping into the rail fastenings 2.

One end of the fibre optic cable 12 is connected to a measuring device 20. The latter sends light impulses into at least one fibre of the fibre optic cable 12 and evaluates the resulting reflections. These reflections depend on the mechanical tension in the respective fibre of the fibre optic cable 12. Such mechanical tensions arise when forces act on the fibre optic cable 12, or when the fibre optic cable 12 is set in vibration by concussions or by noise effects. Via evaluable signal patterns, in particular by a discrete characteristic of the measuring signal, it is also possible to localize the force effect or the vibration actuation.

The method according to the invention for creating the measuring arrangement is explained with reference to the variant in FIG. 5. Serving as an example is a track maintenance operation in which old rails 1 are exchanged for new rails 1 in a continuous working process. In such a rail exchange, the new rails 1 are pre-deposited beside the track. In a first step, the rail fastenings 2 are loosened. A so-called track relaying train is used as track maintenance machine. In a center part, this train has a relaying device which is supported in bridge-like fashion on a front and a rear on-track undercarriage. In this, the front on-track undercarriage travels on the old rails 1, and the rear on-track undercarriage travels already on the new rails 1.

During forward motion of the machine, the relaying device—using suitable guide elements—lifts the old rails 1 from the sleepers 3 and guides them outward next to the track. Using other guide elements, the new rails are guided from the outside to the inside and laid upon the sleepers 3. In the course of this exchanging procedure, rail fastenings 2 of individual sleepers 3 are exposed. This state is used to place the fibre optic cable 12 at the respective clamping points 17.

In this, a spool (cable drum) is arranged in the relaying device, from which the fibre optic cable 12 is reeled off during the machine advance. A positioning device guides the fibre optic cable 12 into the exposed longitudinal grooves 13 of the ribbed base plates 4. This takes place either for one rail line only, or a separate fibre optic cable 12 for each rail line is reeled off from an associated spool. Subsequently, the intermediate layers 7 are laid on the ribbed base plates 4 by means of a suitable laying device.

Only then, the positioning of the new rails 1 between the ribs 8 of the ribbed base plates 4 on the sleepers 3 takes place. In a final work step, the tension clamps 11 are fastened tight by means of the screwed connections 10. During this, the fibre optic cable 12 is also clamped into the corresponding rail fastenings 2.

The invention claimed is:

1. A measuring arrangement for monitoring a railway track having rails fastened to sleepers, the arrangement comprising:

fibre optic cable;

a measuring device coupled to said fibre optic cable in order to detect a strain acting on a rail, at least one rail fastening, wherein the fibre optic cable is clamped in a detachable manner into said at least one rail fastening, wherein the at least one rail fastening includes a lateral guide for lateral support of the rail, and that the clamped fibre optic cable rests against the lateral guide.

2. The measuring arrangement according to claim 1, wherein the fibre optic cable is clamped into the rail fastenings of the same rail at two successive sleepers.

3. The measuring arrangement according to claim 1, wherein, the fibre optic cable has a loop for length compensation between two clamping points.

4. The measuring arrangement according to claim 1, wherein the fibre optic cable is fastened to the rail between two successive sleepers in a detachable manner by means of a fastening means.

5. The measuring arrangement according to claim 1, wherein the at least one rail fastening includes an intermediate layer, and that the clamped fibre optic cable rests against the intermediate layer.

6. The measuring arrangement according to claim 1, wherein the at least one rail fastening includes a tension clamp, and that the clamped fibre optic cable rests against the tension clamp.

7. The measuring arrangement according to claim 1, wherein an angle guide plate is arranged as lateral guide.

8. The measuring arrangement according to claim 1, wherein the at least one rail fastening includes a ribbed base plate, and that ribs extending parallel to the rail are arranged as lateral guide.

9. A method for creating a measuring arrangement for monitoring a railway track having rails fastened to sleepers, wherein a fibre optic cable is connected to a measuring device in order to detect a strain acting on a rail, wherein the fibre optic cable is clamped in a detachable manner into at least one rail fastening wherein, the method comprises:

laying the rail on the sleepers during new track construction or track renewal, by means of a track maintenance machine, that—before, after or during this step there is the step of:

reeling off—the fibre optic cable from a spool arranged on the track maintenance machine and positioning the fibre optic cable at respective clamping points, and that the rail is fastened to the sleepers by means of the rail fastenings while simultaneously clamping the fibre optic cable.

10. A measuring arrangement for monitoring a railway track having rails fastened to sleepers by means of rail fastenings, comprising:

a fibre optic cable a measuring device wherein the fibre optic cable is coupled to the measuring device in order to detect a strain acting on a rail, wherein the fibre optic cable is clamped in a detachable manner into at least one of the rail fastenings, wherein in the clamped state, the fibre optic cable is pressed against a surface of the at least one rail fastening.

11. The measuring arrangement according to claim 10, wherein the fibre optic cable is configured to be reeled off from a cable drum.

12. The measuring arrangement according to claim 10, wherein a strain transmitted from the rail via the at least one rail fastening to the sleeper acts directly on the fibre optic cable.

* * * * *